United States Patent [19]

Itoh et al.

[11] 4,295,354

[45] Oct. 20, 1981

[54] METHOD FOR PRODUCING BEAM BLANK FOR LARGE SIZE H-BEAM FROM FLAT SLAB

[75] Inventors: Koichi Itoh, Ichikawa; Osamu Koshida; Katsuichi Nakayama, both of Ibaraki, all of Japan

[73] Assignee: Sumitomo Metal Industries, Ltd., Osaka, Japan

[21] Appl. No.: 70,831

[22] Filed: Aug. 29, 1979

[30] Foreign Application Priority Data

May 8, 1979 [JP] Japan ..... 54/56073

[51] Int. Cl.[3] ..... B21B 1/12

[52] U.S. Cl. ..... 72/225; 72/234; 72/227; 72/366

[58] Field of Search ..... 72/234, 227, 229, 225, 72/366

[56] References Cited

U.S. PATENT DOCUMENTS 1,156,986 10/1915 Dunn ..... 72/225

4,086,801 5/1972 Nokajima et al. ..... 72/234

*Primary Examiner*—Milton S. Mehr

*Attorney, Agent, or Firm*—Wenderoth, Lind & Ponack

[57] ABSTRACT

A beam blank for a large size H-beam is produced firstly by forming flat slab into a preformed beam blank by a two-high rolling mill and subsequently by rolling the preformed beam blank by a universal roughing mill.

3 Claims, 16 Drawing Figures

METHOD FOR PRODUCING BEAM BLANK FOR LARGE SIZE H-BEAM FROM FLAT SLAB

BACKGROUND OF THE INVENTION

The present invention relates to a method for producing a beam blank for a large size H-beam for a large size flat slab.

The heretofore proposed methods for producing a beam blank for a large size H-beam include a method for producing such beam blank from an ingot by a blooming mill and a method using continuous casting. However, these heretofore proposed methods have serious disadvantages.

In the method using the blooming mill, a flaw on the ingot remains in the beam blank and the beam blank has to be conditioned to remove the flaw and further the beam blank has to be reheated. While another approach has been proposed, namely to locate a blooming works close to a large size beam works so that a beam blank from the blooming works can be directly rolled into a beam without reheating, this approach also is not free from the problem of flaws in the product and is not advantageous in view of the problem of balance in efficiency between the blooming and the beam rolling.

On the other hand, the method for producing a beam blank by continuous casting is very disadvantageous in that continuous casting practice has not yet established a technique for changing casting size which can sufficiently cope with the problem of production of many different types of products in small quantities which is characteristic of production of beams and that a continuous casting machine not usable with a common casting machine for flat slab and, therefore, requires a considerable amount of investment in plant and equipment.

SUMMARY OF THE INVENTION

An object of the present invention is to provide a method for producing a beam blank for a large size H-beam from a flat slab which is supplied with a high efficiency and in a stable quality by a modern steel works.

Another object of the present invention is to provide a method for producing a beam blank for a large size H-beam from a flat slab using a two-high break down mill and a universal roughing mill which are normally present in a common large size rolling works.

A further object of the present invention is to provide a method for producing a beam blank for a large size H-beam from a flat slab with only a few changes in an already existing large size rolling works substantially without addition of any special facility therefor.

According to the method of the present invention, a large size flat slab is turned 90 degrees about a side edge thereof to place the widthwise direction thereof in the vertical direction and is rolled into a preformed beam blank by a two-high break down mill, and then the preformed beam blank thus produced is again turned 90 degrees about the lower edge thereof into the horizontal position and rolled into a beam blank for an H-beam by a universal roughing mill.

The term "large size flat slab" used herein and in the claims is to be understood to mean any steel piece produced as a slab either by blooming or by continuous casting in a steel works.

Such flat slabs are manufactured with high efficiencies, in large qualities and by many methods by well established techniques of the modern steel making.

Therefore, the method according to the present invention using such flat slabs as starting blanks can achieve a very large economical advantage.

Further, according to the method of the present invention, the preformed beam blank is rolled by the universal mill in such a way that said preformed beam blank is rolled in earlier passes with the reduction of the blank by the horizontal rolls of said mill being greater than the reduction by the vertical rolls thereof and in the later passes with the reduction by the horizontal rolls of said mill less than the reduction by the vertical rolls thereof. The terms "earlier passes" and "later passes" used herein and in the claims are to be understood to mean the first half and the second half, respectively, of the entire number of passes through the universal mill.

BRIEF DESCRIPTION OF THE DRAWINGS

The invention will be better understood from the following description taken in connection with the accompanying drawings in which.

DESCRIPTION OF THE PREFERRED EMBODIMENTS

Certain preferred embodiments of the present invention will now be described with reference to the drawings.

Figure 1:
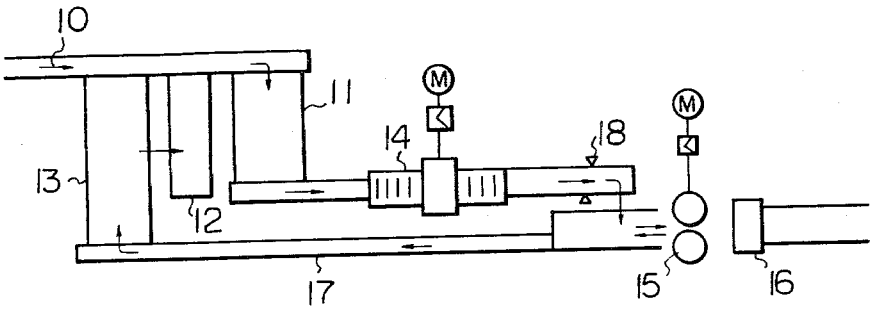
FIG. 1 is a schematic illustration of a large size H-beam production line for the practice of the method according to the present invention.

Shown schematically in FIG. 1 is a conventional large size H-beam production line partially remodeled for practice of the method according to the present invention. A flat slab S (see FIG. 2A) is carried in the direction of an arrow 10 by suitable conveyor equipment and charged into a heating furnace 11, in which it is uniformly heated to an adequate temperature above 1150° C. and then carried to a two-high rolling mill 14. The flat slab S is turned 90 degrees about a side edge thereof to position the widthwise direction thereof in the vertical direction and is rolled by being passed horizontally through the rolling mill 14 in several passes into a preformed beam blank X, as shown in FIGS. 2A to 2D.

The preformed beam blank X thus produced has a square-shaped tang formed at an end of the portion corresponding to a flange, which adversely effects the roll biting of a universal roughing mill in a succeeding step. Accordingly, the tang is removed by a tang cutting saw 18.

Figure 8:
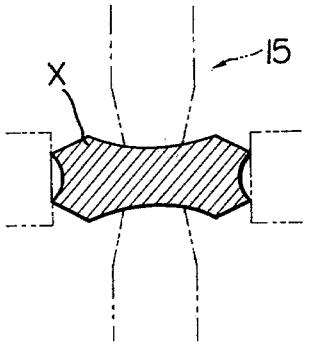
FIGS. 8A and 8B are sectional views of the preformed beam blank made from the flat slab in the earlier passes of a universal roughing mill and the beam blank formed from the preformed beam blank in the later passes, respectively.
Figure 8:
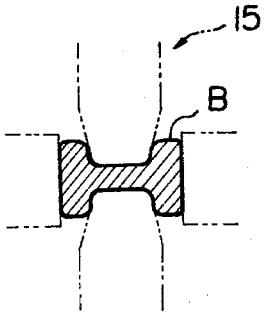

The preformed beam blank X is carried by suitable conveyor means (not shown) such as rollers or a table into a universal roughing mill 15 and an edger mill 16 which are arranged in tandem, and the universal roughing mill 15 alone rolls the preformed beam blank X into a beam blank B (see FIG. 8B) in a number of reversing passes.

The beam blank B thus produced is carried by conveyor means 17 into a hot bed 13 and a warming furnace 12 or a cooling bed (not shown) and held therein until it is charged into the heating furnace and rolled into an H-beam.

Figure 2A:
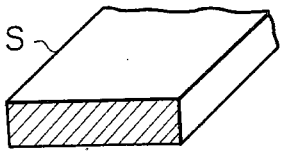
FIGS. 2A to 2D are illustrations of steps for reducing a flat slab into a preformed beam blank by a two-high rolling mill.
Figure 2B:
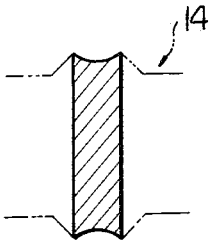
Figure 2C:
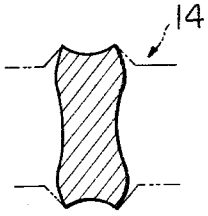
Figure 2D:
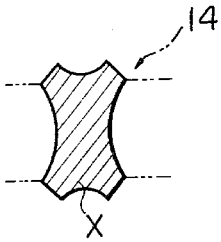

Reverting to FIGS. 2A to 2D, in rolling of the flat slab S (see FIG. 2A) by the two-high rolling mill 14, deformation or metal flow occurs locally in regions adjacent the opposite ends of the cross-section of the material, leaving the central region of the cross-section thereof almost unchanged, so that the material is deformed at the opposite ends along the roll profile to thereby produce the preformed beam blank X of dog-bone shape (see FIG. 2D).

Figure 3:
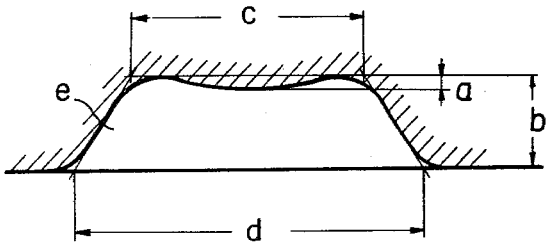
FIG. 3 is a sectional view of a roll profile of the two-high roughing mill.

The inventors have discovered through experiments that the two-high rolling mill 14 preferably should have a grooved roll with the shape shown in FIG. 3 for the reason described below.

A bottom crowning a is necessary for forcibly causing metal flow along the profile in the opposite ends of the cross-section of the flat slab S to provide the preformed beam blank and for enlarging the expanded regions on both sides adjacent the opposite ends of the cross-section thereof. The groove depth b of the profile must be sufficient for securing the volume of shoulders e of the preformed beam blank X necessary for securing a required flange width of the desired H beam and is limited by the mill capacity, cross-sectional dimensions of the flat slab S as a blank, and other design conditions of the profile. In this embodiment, the groove depth b is preferably limited by the condition expressed by the equation $b=f+f'$, where $f=(1.1 \text{ to } 1.5)f_o$ and f' is from 20 to 40 mm, and f and $f_o$ denote the flange thickness of the preformed beam blank X and the beam blank B (see FIG. 4). The width c of the bottom of the caliber is preferably the same as or 10 to 20% larger than the thickness t of the flat slab S, in view of the necessity of restraining the material with the roll profile for stabilizing the rolling operation and of the difficulty of securing equal deformation on both sides of the flat slab S on the contact surfaces with the rolls. The width d of the opening of the profile must be sufficient for securing the required dimensions of the flange of the product. By increasing the width d, the shoulders e to be deformed into flange ends in the succeeding step are formed to thereby prevent inferior shapes of the flange ends of the beam blank B. That is, in the universal roughing mill 15 in the succeeding step, the flanges are deformed more in the sides in contact with the vertical rolls and, accordingly, the width d is preferably large in the two-high rolling mill 14 but is limited naturally by the deformations in the opposite ends of the cross-section of the flat slab S. In this embodiment, the width d preferably has value determined by the equation $d=M+M'$, where M denotes the flange width of the preformed beam blank X (see FIG. 4) and M' is from 15 to 35 mm.

Figure 4:
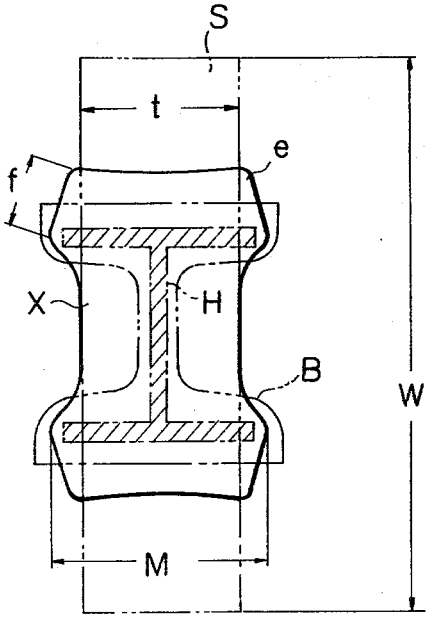
FIG. 4 is a sectional view showing the dimensional relation between the flat slab and the preformed beam blank made therefrom.

In the method according to the present invention, as shown in FIG. 4, the flat slab S preferably has a sectional area of 0.1 $m^2$ or larger and the thickness to width ratio of the section is from 1:2.0 to 1:6. More particularly, the thickness t is 200 mm to 400 mm and the width W is 400 mm to 2000 mm firstly because flat slabs with dimensions in the above range are produced in large quantities in steel mills and secondly because flat slabs having cross-sectional areas smaller than 0.1 $m^2$ are not suitable for production of large size H-beams. Flat slabs with a thickness to width ratio smaller than 2.0 are economically not suitable because such slabs require further reduction in thickness to secure the required web thicknesses and flange heights. On the other hand, a thickness to width ratio larger than 1:6 is also unsuitable because slabs with such a ratio require impractically large sectional deformations to secure the required flange heights.

FIG. 4 shows the dimensions of each of the flat slab S used as the starting material in the method according to the present invention, the preformed beam blank X of dog-bone shape made from the flat slab S by continuous rolling according to the present invention, and the final product H formed from the preformed beam blank X by further rolling.

Figure 5:
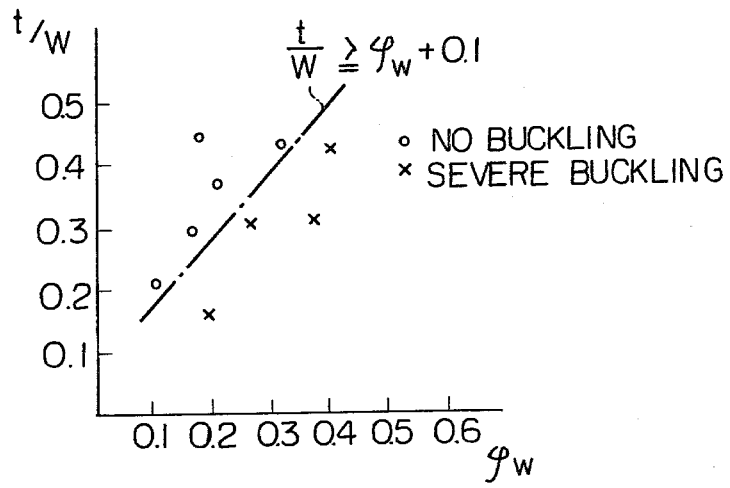
FIG. 5 is a graph showing the results of an experimental process for determining the conditions for buckling of the flat slab.

The flat slab S is edging-rolled with the widthwise direction in the vertical position. When the thickness to width ratio t/w is small and the reduction $\phi_w$ is large, however, the flat slab S tends to be buckled. Accordingly, the flat slab S is preferably edging-rolled to achieve the reduction $\phi_w$ within the range shown in FIG. 5 in which the horizontal axis denotes a widthwise reduction $\phi_w$ and the vertical axis denotes the thickness to width ratio t/w. If the slab width before rolling is taken as $W_1$ and the slab width after rolling is taken as $W_2$, the reduction $\phi_w$ is expressed by the equation $\phi_w=\log_e(W_2/W_1)$. From the experimental results shown in FIG. 5, the conditions which do not cause buckling in the slab S are expressed by the formula $t/w \geqq \phi_w+0.1$. In FIG. 5, small circles and small X's represent the conditions where no buckling was caused and the conditions where severe bucklings were caused, respectively.

Figure 6:
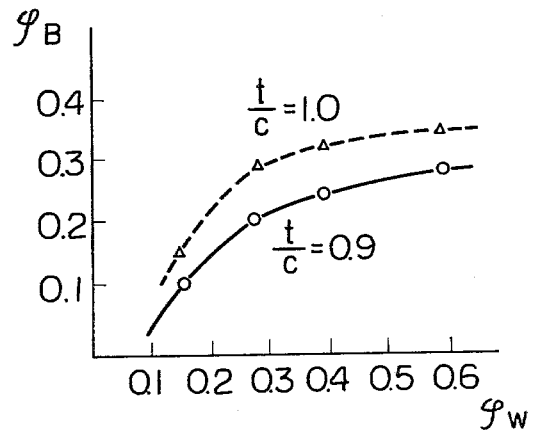
FIGS. 6 and 7 are graphs showing the results of experiments for determining the relations between the dimensions of the flat slab and the shape of the roll profile of the two-high rolling mill.
Figure 7:
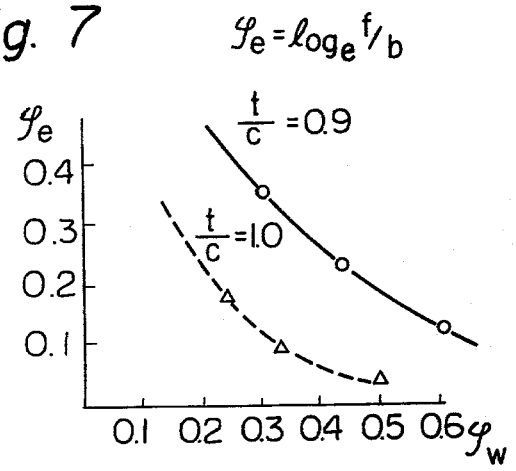

When proper dimensions of the roll profile are determined according to the conditions described above, the reduction $\phi_w$ and the shape of the roll profile are in the relation shown in FIGS. 6 and 7. In FIG. 6, the vertical axis denotes the width spread rate $\phi_B$ of the flange width M of the preformed beam blank X. If the flange width before rolling is taken as $M_1$ and the flange width after rolling is taken as $M_2$, the flange width spread rate $\phi_B$ is expressed by the equation $\phi_B=\log_e(M_2/M_1)$. As shown in FIG. 6, the flange width M varies depending upon the shape of the roll profile (bottom width c) and the thickness t of the flat slab S and increases as both the thickness t of the slab S and the reduction $\phi_w$ increases. In FIG. 7, the vertical axis denotes the filling rate $\phi_e(=-\log_e f/b)$ in the shoulders e of the preformed beam blank X. As seen from FIG. 7, the flange thickness f will increase as both the thickness of the flat slab S and the reduction $\phi_w$ increases.

In the universal roughing mill 15, the preformed beam blank X having the shape shown in FIG. 8A is rolled gradually into the shape shown in FIG. 8B. In the method according to the present invention, however, the preformed beam blank X, which is edge profile from the flat slab S but is flat, requires severe reduction in the flanges to secure the necessary flange width of the product.

The inventors have found that pass schedules should be determined preferably on the basis of the following rules in the rolling of the preformed beam blank X by the universal roughing mill 15:

Rule 1: In the earlier passes, the thickness reduction $\phi_{tw}$ by the horizontal rolls is larger than the thickness reduction $\phi_{tf}$ by the vertical rolls, and in the later passes, the reduction $\phi_{tw}$ is smaller than the reduction $\phi_{tf}$.

Rule 2: Reduction in each pass is performed under the condition that the difference between the length $l_{df}$ of the area of contact between the vertical roll and the flange at the time of biting of the material and the length $l_{dw}$ of the area of contact between the horizontal roll and the web, namely $l_{df}-l_{dw}$, is 80% or less of the length $L_t$ of the tang to be formed in the web.

Rule 3: The dividing line between the earlier passes and the later passes is approximately in the middle of the total number of passes.

Figure 10:
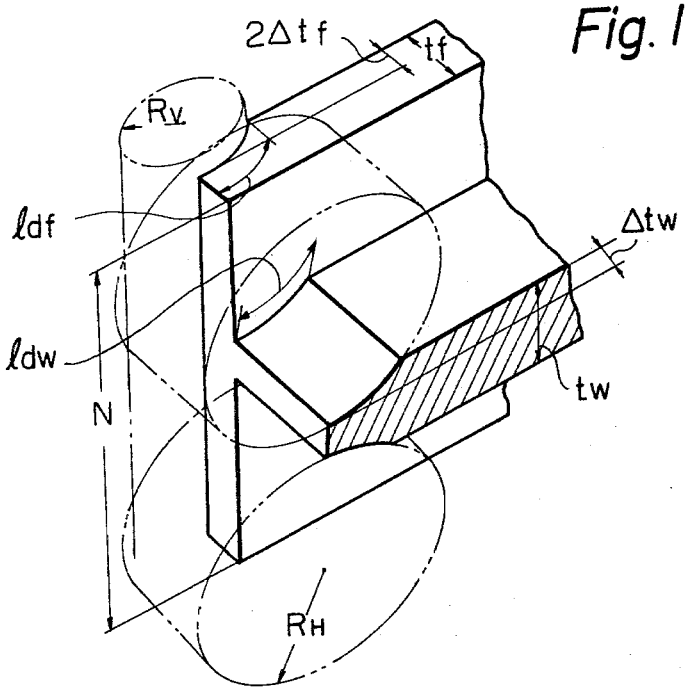
FIG. 10 is a perspective view showing the areas of contact of the material with the vertical roll and the horizontal rolls, respectively, of the universal roughing mill at the time of biting of the material thereby.
Figure 11:
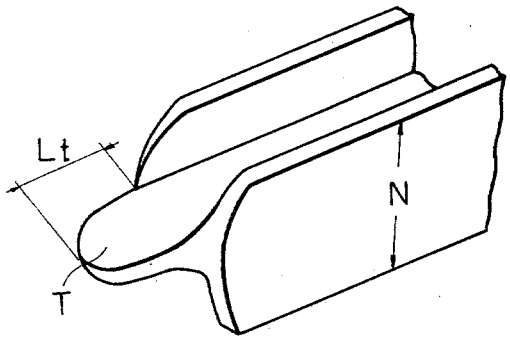
FIG. 11 is a perspective view of a tang formed in a web of the material being rolled.

The contact lengths $l_{df}$ and $l_{dw}$ defined in Rule 2 are illustrated in FIG. 10. The tang length $L_t$ also described in Rule 2 is illustrated in FIG. 11.

The determination of the pass schedule in the universal roughing mill 15 is one of the important characteristic features of the present invention and will now be described with reference to FIGS. 8 to 12.

Rule 1 will first be described. The inventors have found that the flange width spread rate $\phi_B$ is given by the following formula:

$$\phi_B=\alpha(\phi_{tf}-\phi_{tw})+\beta \quad (1)$$

where, $\phi_{tf}$: flange thickness reduction $\phi_{tw}$: web thickness reduction $\alpha\beta$: constants For reference, as shown in FIG. 10, if the dimensions of the material to be rolled are defined as follows, the reductions $\phi_{tf}$ and $\phi_{tw}$ are expressed by the following equations:

$$\phi_{tf} = \log_e \frac{tf_2}{tf_1}$$

$$\phi_{tw} = \log_e \frac{tw_2}{tw_1}$$

where, $tf_1$: flange thickness before rolling $tf_2$: flange thickness after rolling $tw_1$: web thickness before rolling $tw_2$: web thickness after rolling Further, if the flange width of the material to be rolled is taken as N and its dimensions before and after rolling are taken as $N_1$ and $N_2$, respectively, the flange width spread rate $\phi_N$ is expressed by the following equation:

$$\phi_N = \log_e \frac{N_2}{N_1}$$

The constants $\alpha$ and $\beta$ in formula (1), unlike in the rolling of a common H-beam, vary considerably dependent upon the shape of the material to be rolled (namely the shape of the rolling profile) particularly from larger values to smaller ones as the pass number increases. Accordingly, for obtaining a large value of the flange width spread rate $\phi_B$, it is advantageous to enlarge the flange reduction $\phi_{tf}$ in the earlier passes but this is limited in actual operations by roll biting for the reason to be described below.

Figure 9:
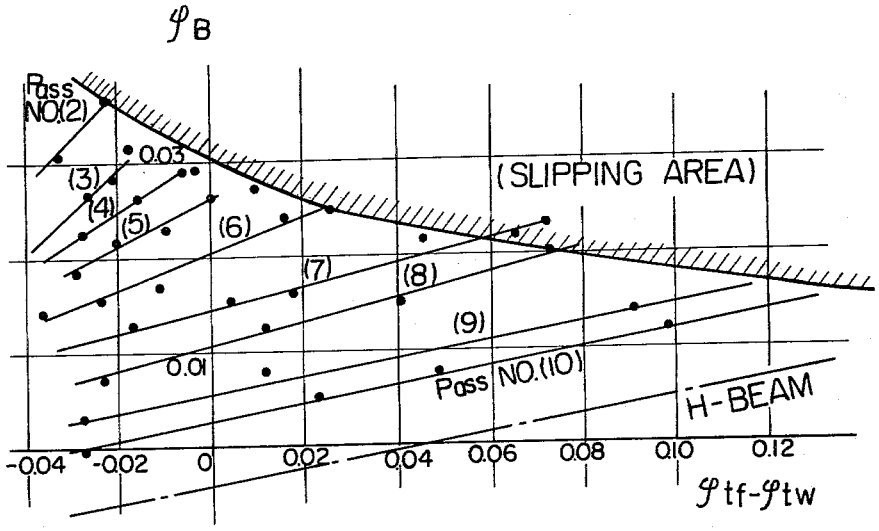
FIG. 9 is a graph showing the results of experiments for determining the relations between the difference in reduction ($\phi_{tf}-\phi_{tw}$) between the flanges and the webs of the preformed beam blank being rolled by the universal roughing mill for each pass and the flange spread rate $\phi_B$.

FIG. 9 graphically shows the relation between the values $\phi_B$ and $(\phi_{tf}-\phi_{tw})$ obtained experimentally for each pass. As seen from FIG. 9, in the earlier passes both the values $\alpha$ and $\beta$ are large and, accordingly, the flange width spread rate $\phi_B$ is secured even under the condition $\phi_{tf}-\phi_{tw}<0$. In the later passes, however, the required flange width spread rate $\phi_B$ cannot be obtained unless the condition $\phi_{tf}-\phi_{tw}>0$ is satisfied. In FIG. 9, the curve plotting the largest $\phi_B$ value of each pass indicates the limits resulting from the roll biting. As is clear from formula (1), the larger the value $(\phi_{tf}-\phi_{tw})$ is, the larger the flange width spread rate $\phi_B$ can be. However, if the value $(\phi_{tf}-\phi_{tw})$ is larger than the limit, the material is not bitten by the rolls, making rolling impossible. This phenomenon results from the characteristic feature of the universal roughing mill that the vertical rolls are idle rolls and the material biting and driving force is provided exclusively by the horizontal rolls.

However, for producing the beam blank B using, as in the present invention, the preformed beam blank X obtained from the flat slab S, the flange width spread rate $\phi_B$ must be large and material of good quality that is uniformly deformed in each pass must be provided.

Accordingly, the present invention has as an object to predict the limit of biting of each pass and to determine the optimum pass schedule within the limits.

Rules 2 and 3 will now be described.

The slippage of the material results, as described above, generally from the characteristic feature of the universal roughing mill that the vertical rolls are idle and is, more specifically, related to the difference $(l_{df}-l_{dw})$ between the lengths $l_{df}$ and $l_{dw}$ of the areas of contact of the material with the vertical rolls and with the horizontal rolls, respectively.

FIG. 10 illustrates the contact lengths at the time of biting of the material. As seen from FIG. 10, the contact lengths $l_{df}$ and $l_{dw}$ can be expressed by the following formulas, respectively:

$$l_{df}=\sqrt{2R_V\cdot\Delta_{tf}} \quad (2)$$

$$l_{dw}=\sqrt{R_H\cdot\Delta_{tw}} \quad (3)$$

where, $R_V$: radius of vertical roll $R_H$: radius of horizontal roll $2\Delta_{tf}$: flange thickness reduction $\Delta_{tw}$: web thickness reduction Principally, $(l_{df}-l_{dw})<0$ is considered to be a condition for biting. However, if a tang T is formed as shown in FIG. 11, the biting ability is increased and, accordingly, the value of the difference between the contact lengths ($l_{df}-l_{dw}$) can be made larger.

Figure 12:
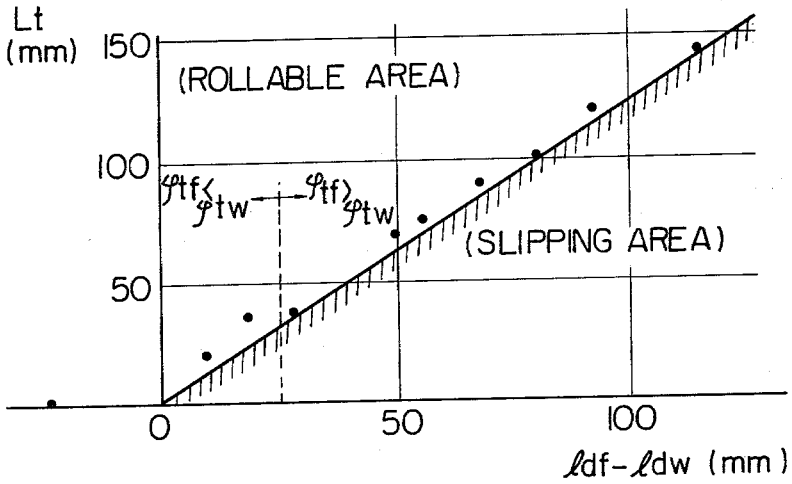
FIG. 12 is a graph showing an example of determination of the optimum pass schedule within the material biting range from the relation between the difference in the lengths of the contact areas ($l_{df}-l_{dw}$) and the tong length ($L_t$).

The inventors have found that rolling is possible when the length of the tang $L_t$ satisfies the condition expressed by the following formula, experimental results of which are shown in FIG. 12:

$$0.8L_t \geqq (l_{df}-l_{dw}) \quad (4)$$

Accordingly, in the earlier passes if the thickness reduction $\phi_{tw}$ by the horizontal rolls is larger than the thickness reduction $\phi_{tf}$ by the vertical rolls the growth of the tang T is promoted, and the value of the difference between the contact lengths ($l_{df}-l_{dw}$) can be made larger as the pass number advances. Here, if the flange thickness before reduction is taken as $tf_1$ and the web thickness before reduction is taken as $tw_1$, $\phi_{tf} \approx \Delta_{tf}/tf_1$ and $\phi_{tw} \approx \Delta_{tw}/tw_1$. Accordingly, formulas (2) and (3) can be expresses as follows, respectively:

$$l_{df}=\sqrt{2R_V \cdot \phi_{tf} \cdot tf_1} \quad (2)'$$

$$l_{dw}=\sqrt{R_H \cdot \phi_{tw} \cdot tw_1} \quad (3)'$$

Substituting formulas (2)' and (3)' into formula (4), $$0.8L_t \geqq \sqrt{2R_V \cdot \phi_{tf} \cdot tf_1}-\sqrt{R_H \cdot \phi_{tw} \cdot tw_1} \quad (4)'$$

In formula (4)', since the values of $L_t$, $R_V$, $R_H$, $tf_1$, and $tw_1$ are known, the values $\phi_{tf}$ and $\phi_{tw}$ can be so determined as to satisfy formula (4)' within the range of the mill capacity and to provide the largest flange width spread rate $\phi_B$ from formula (1).

EXAMPLE

An example of operation according to the method of the present invention is shown in Table 1.

Dimensions of the starting slab S:

Thickness t=270 mm

Width w=1025 mm

Thickness to Width ratio t/w=1/3.8

Dimensions of the produced beam blank B:

Web thickness=100 mm

Flange thickness=100 mm

Flange width=380 mm

Web height=440 mm

TABLE 1

| | | Pass Schedule | | | Characteristic Value | | Rolling Results | | |
|---|---|---|---|---|---|---|---|---|---|
| | | Web Thickness (mm) | Flange Thickness (mm) | Web Height (mm) | Reduction Difference $\phi_{tf}-\phi_{tw}$ | Contact Length Difference $l_{df}-l_{dw}$ (mm) | Tang Length Top (mm) | Tang Length Bottom (mm) | Flange Width (mm) |
| Blank Slab | | 270 | — | 1025 | — | — | — | — | 270 |
| Beam Blank from Break Down | | 268 | 266 | 750 | — | — | −100 | −120 | 360 |
| Universal Roughing Rolling | Pass 1 | 266 | 266 | 750 | −0.007 | −36 | −80 | −110 | 355 |
| | 2 | 238 | 262 | 746 | −0.096 | −94 | −50 | −70 | 352 |
| | 3 | 214 | 251 | 728 | −0.064 | −37 | −30 | −35 | 352 |
| | 4 | 192 | 239 | 703 | −0.059 | −48 | 0 | −20 | 354 |
| | 5 | 172 | 224 | 678 | −0.045 | −10 | 20 | 20 | 358 |
| | 6 | 157 | 208 | 648 | −0.017 | 15 | 40 | 30 | 364 |
| | 7 | 144 | 189 | 612 | 0.009 | 22 | 50 | 50 | 368 |
| | 8 | 131 | 168 | 572 | 0.023 | 40 | 70 | 60 | 372 |
| | 9 | 120 | 146 | 530 | 0.052 | 51 | 80 | 80 | 375 |
| | 10 | 110 | 124 | 486 | 0.076 | 58 | 95 | 90 | 378 |
| | 11 | 100 | 100 | 440 | 0.120 | 61 | 100 | 110 | 380 |

A preformed beam blank X having a flange width of 360 mm and a flange end thickness 200 mm was obtained by five passes of the slab through the break down mill. The beam blank X was further rolled by the succeeding universal roughing mill with the contact length difference ($l_{df}-l_{dw}$) less than 80% of the tang length $L_t$ into a beam blank B with a web thickness of 100 mm, a flange thickness of 100 mm, a flange width of 380 mm and a web height of 440 mm. In this example, the beam blank coming from the break down mill was not cropped. If cropped, the biting of the beam blank by the vertical rolls will be made easier to thereby make it possible to apply a strong reduction to the flange and to produce a beam blank having a large flange width.

While we have described and illustrated a preferred method of practicing the present invention, it is to be distinctly understood that the invention is not limited thereto but may be otherwise variously practiced within the scope of the following claims.

What is claimed is:

1. A method for producing a beam blank for a large size H-beam from a flat slab, comprising the steps of:

positioning a large size flat slab with the width dimension vertical and rolling the vertically spaced edges a plurality of times in a two-high rolling mill to form a preformed beam blank, the shaping rolls of the two-high rolling mill having a roll profile with a groove-shaped recess therein having a depth b a width c at the bottom thereof and width d at the opening thereof, with dimensions of:

$$t \leqq c \leqq 1.2t$$

$$d=M+M'$$

$$b=f+f'$$

t is the thickness of the flat slab

M is the width of the flange of the beam blank to be formed

M' is a dimension of from 15 to 35 mm f is the thickness of the flange of the beam blank to be formed; and f' is a dimension from 20 to 40 mm; and positioning said preformed beam blank with the width dimension thereof horizontal and further rolling the preformed blank by plurality of passes through a universal roughing mill into a beam blank of the desired shape, the rolling in the earlier passes through the universal roughing mill being with the rolls of the roughing mill position for making the reduction of the preformed beam blank by the horizontal rolls greater than the reduction by the vertical rolls thereof and the rolling in the later passes being with the rolls of said roughing mill positioned for making the reduction of the preformed beam blank by the horizontal rolls less than the reduction by the vertical rolls thereof.

2. A method according to claim 1 in which said flat slab is rolled for making the widthwise reduction $\phi_w$ thereof according to the following condition:

$$\phi_w \leqq t/w - 0.1$$

where, t is the thickness of the flat slab and w is the width of the flat slab.

3. A method according to claim 1 in which the rolling by said universal roughing mill is performed under the following condition:

$$0.8L_t \geqq (l_{df} - l_{dw})$$

where, $L_t$ is the length of the tang formed in the material being rolled $l_{df}$ is the length of the area of contact between the material being rolled and the respective vertical rolls, and $l_{dw}$ is the length of the area of contact between the material being rolled and the respective horizontal rolls.

* * * * *